United States Patent [19]

Inoue

[11] 4,379,640

[45] Apr. 12, 1983

[54] TIMEPIECES HAVING A DEVICE OF REQUESTING AND RECITING TIME SETTINGS IN THE FORM OF AUDIBLE SOUNDS

[75] Inventor: Tomohiro Inoue, Nara, Japan

[73] Assignee: Sharp Kabushiki Kaisha, Osaka, Japan

[21] Appl. No.: 302,130

[22] Filed: Sep. 14, 1981

Related U.S. Application Data

[63] Continuation of Ser. No. 96,319, Nov. 21, 1979, abandoned.

[30] Foreign Application Priority Data

Nov. 22, 1978 [JP] Japan ..... 53-144401

[51] Int. Cl.[3] ..... G04B 21/08; G10L 1/00

[52] U.S. Cl. ..... 368/63; 179/1 SM; 364/710

[58] Field of Search ..... 368/63, 250–251; 364/710; 179/1 SA, 1 SM

[56] References Cited

U.S. PATENT DOCUMENTS

| | | | |
|---|---|---|---|
| 3,982,070 | 9/1976 | Flanagan | 179/1 SM |
| 3,998,045 | 12/1976 | Lester | 368/63 |
| 4,185,170 | 1/1980 | Morino et al. | 364/710 |
| 4,279,030 | 7/1981 | Masuzawa et al. | 368/63 |

*Primary Examiner*—Vit W. Miska

*Attorney, Agent, or Firm*—Birch, Stewart, Kolasch and Birch

[57] ABSTRACT

A voice-synthesizer timepiece capable of providing advance announcement before time settings and reciting time setting is required already entered, in the form of synthesized voices is disclosed. For example, in the voice-synthesizer timepiece disclosed herein, an audible message "please set time in hours and minutes soon" is given in advance of a time set mode and time settings are audibly recalled in such a form as "X (in hours) and Y (in minutes) have already set" after the setting of time.

3 Claims, 8 Drawing Figures

| | Ls | LH | LM | Lsl | LT | LJ |
|---|---|---|---|---|---|---|
| m1 (13) | ACreset | ACreset | ACreset | ACreset | ACreset | ACreset |
| m2 | | TH | TH | TH | TH | |
| m3 | Pa2 | | | | | Pa1 |
| m4 | | Pa5 | Pa5 | Pa5 | Pa5 | |
| m5 | Pa5 | | | TM | TM | Pa5 |
| m6 | | Pa8 | Pa8 | | | TH |
| m7 | Pa2 | | | Pa5 | Pa5 | |
| m8 | | Pa2 | Pa2 | | | Pa4 |
| m9 | Pa5 | | | Pa2 | | |
| m10 | | Pa10 | | | | |
| m11 | Pa2 | | | Pa2 | | Pa4 |
| m12 | | Pa1 | | | | |
| m13 | Pa2 | | | | | Pa2 |
| m14 | | Pa5 | | | | |
| m15 | | | | | | Pa2 |
| m16 | | Pa4 | | | | |
| m17 | | | | | | Pa6 |
| m18 | | Pa2 | | | | |
| m19 | | | | | | Pa6 |
| m20 | | Pa2 | | | | |
| m21 | | | | | | Pa6 |
| m22 | | | | | | |
| m23 | | | | | | Pa6 |
| m24 | | | | | | |

FIG. 4

TIMEPIECES HAVING A DEVICE OF REQUESTING AND RECITING TIME SETTINGS IN THE FORM OF AUDIBLE SOUNDS

This application is a continuation, copending application Ser. No. 096,319, filed on Nov. 21, 1979, now abandoned.

BACKGROUND OF THE INVENTION

This invention relates to a voice-synthesizer timepiece capable of requesting and/or reciting time settings in the form of synthesized voices when in a time set mode.

A voice-synthesizer timepiece has already been proposed in U.S. Pat. No. 3,998,045, *TALKING SOLID STATE TIMEPIECE,* assigned to Camin Ind. However, no consideration was of audibly announcing time setting functions.

Accordingly, it is an object of the present invention to provide a voice-synthesizer timepiece capable of providing advance announcement before time setting is required and reciting time settings already entered, in the form of synthesized voices. For example, in a voice-synthesizer timepiece according to the present invention, an audible message "please set time in hours and minutes soon" is given in advance of a time set mode and time settings are audibly recalled in such a form as "X(in hours) and Y(in minutes) have already been set" after the setting of time.

BRIEF DESCRIPTION OF THE DRAWINGS

For a more complete understanding of the present invention and for further objects and advantages thereof, reference is now made to the following description taken in conjunction with the accompanying drawings, in which:

FIG. 4 is a flow chart showing word data.

DETAILED DESCRIPTION OF THE INVENTION

Figure 1:
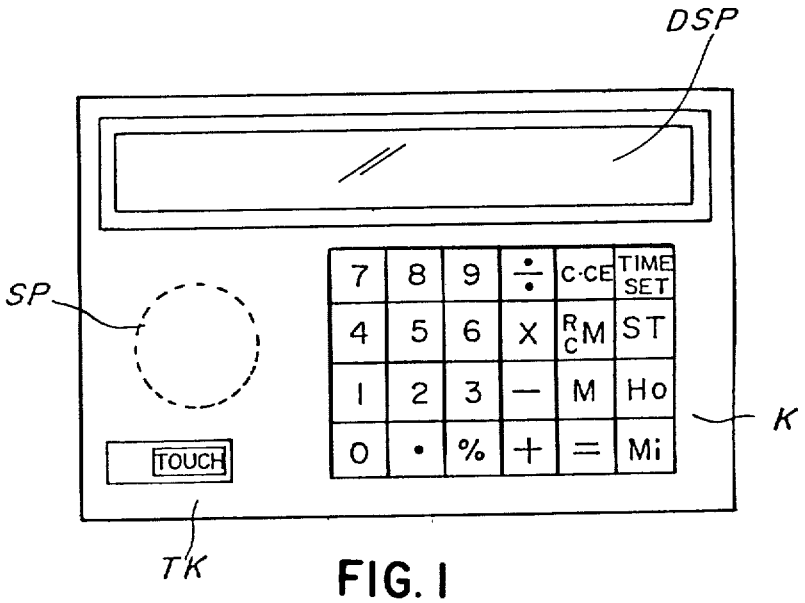
FIG. 1 is a plan view of the other appearance of a clock calculator embodying the present invention.
Figure 2B:
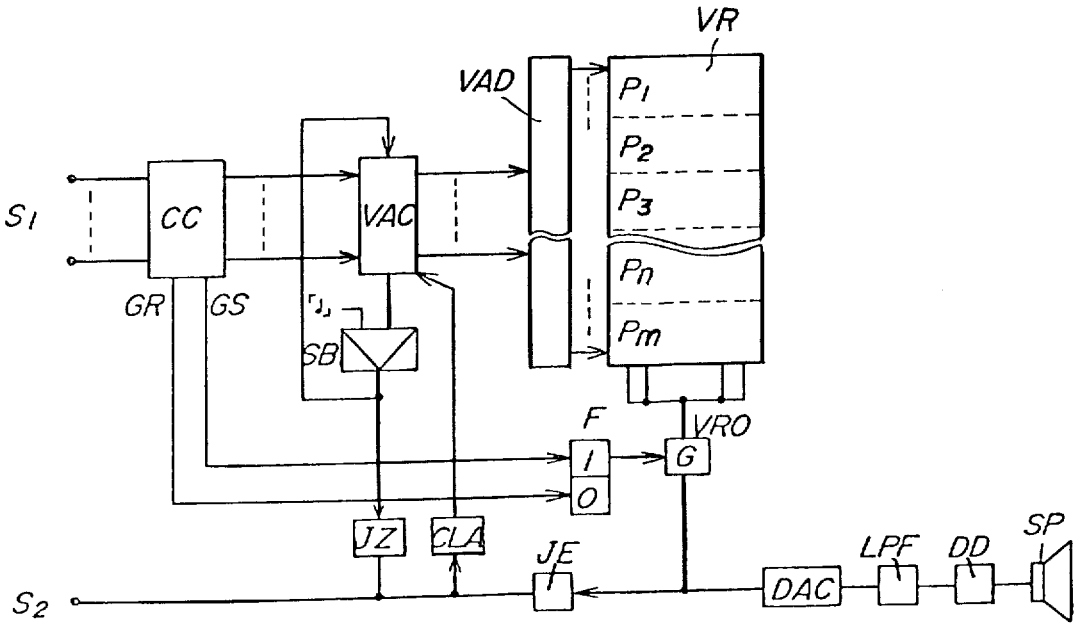
FIGS. 2(A) and 2(B) are block diagrams of a principal circuit configuration of the clock calculator of FIG. 1.
Figure 2A:
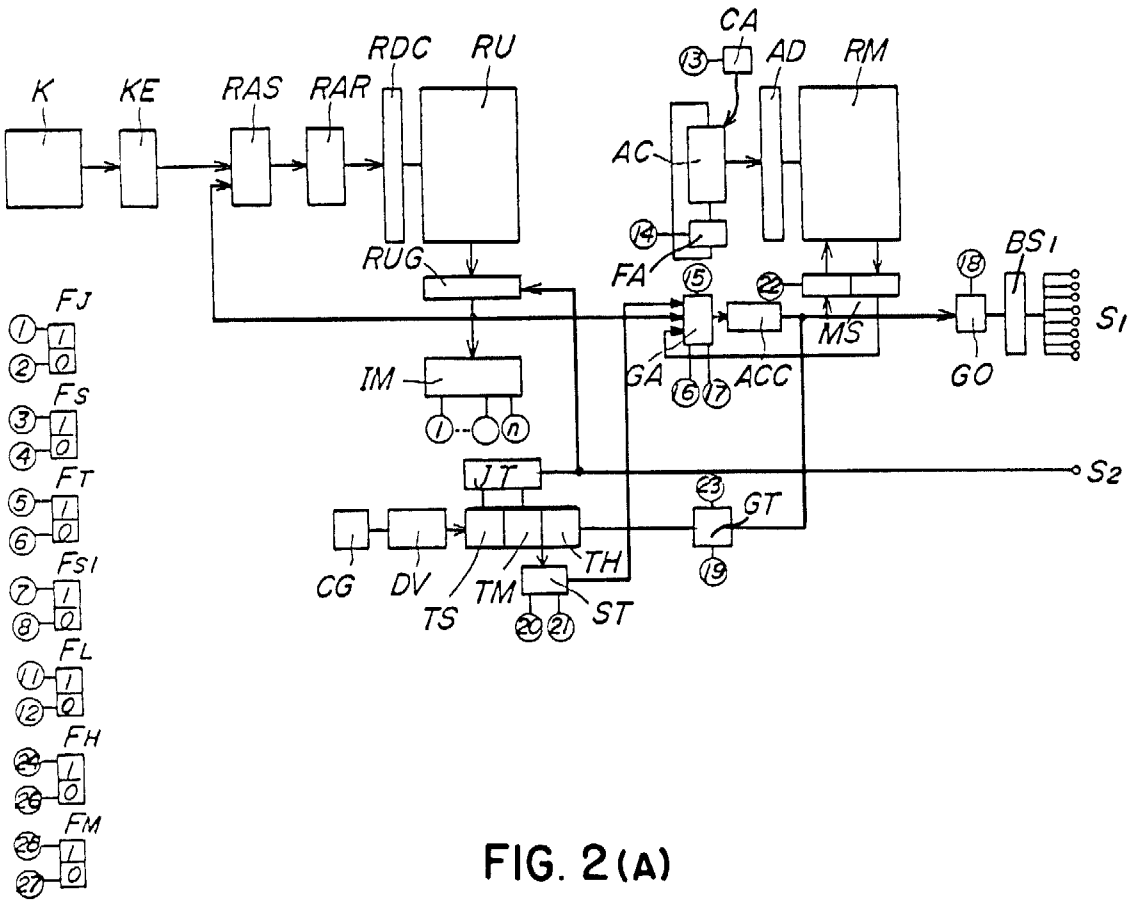

FIG. 1 is a plan view of the outer appearance of a clock calculator for which the present invention is applied and FIGS. 2(A) and 2(B) are block diagrams showing principal circuit configuration of the clock calculator of FIG. 1. It is obvious to those skilled in the art that the present invention is also equally applicable to any other types of timepieces such as solid state wristwatches.

There is illustrated a keyboard K, a keyboard encoder KE which converts signals entered via the keyboard K into corresponding codes, a program memory RU implemented with a well known read only memory, an address register RAR, an address decoder RDC, and instruction selection gates RUG. An instruction decoder IM is adapted to generate microinstructions ①-ⓝ according to the contents of the program memory RU inputted via the instruction selection gates RUG. There are further provided a memory unit RM consisting of a random access memory, an address counter AC, an address decoder AD, an input/output control circuit MS, an adder FA incrementing the address counter AC and a reset circuit CA for resetting the counter AC. An accumulator is labeled ACC, an input gate to the accumulator ACC is labeled GA, an output buffer is labeled $BS_1$ and an input gate thereto is labeled GO.

A clock generator CG and a frequency divider DV generate time base signals for timekeeping. A seconds register TS, a minutes register TM and a hours register TH are further provided in relation with the divider DV. Although not shown in the drawings, registers storing time or calender information in other units of time such as a date register and a month register may be provided. An input gate GT is provided for the minutes register TM and the hours register TH as well as an output selection gate ST. A specific time detector JT senses if the contents of the seconds register TS and the minutes register TM reach 59 minutes and 50 seconds.

A memory unit VR of a read only memory storing sound quantizing data has an address counter VAC and an address decoder VAD. A reset circuit CLA resets the address counter VAC in order to inhibit the delivery of an audible output by failing to specify any of the addresses of the memory unit VR. A subtractor SB decrements one of the address of the addresses counter VAC and, after an initial address has been set up in the address counter VAC for a desired one of voice regions P, executes the operation of VAC−1→VAC automatically at a fixed sampling frequency, thus fetching the sound quantizing data in sequence from that region P. The memory unit VR is provided with an output gate G. An END code detector JE is adapted to sense an END code located at the final step of the respective regions P and provide an output for rendering the reset circuit CLA operative to reset the address counter VAC. A reset state detector JZ senses if the address counter VAC is in the reset state and is connected to the instruction selection gate RUG together with the outputs as denoted as $S_2$ of the END code detector JE and the specific time detector JT and so forth.

A code converter CC receives voice region identifying signals $S_1$ supplied from the output buffer $BS_1$ and converts initial addresses of selected ones of the voice regions P into codes compatible with the address counter VAC. A flip-flop F controls the output gate G of the memory unit VR. The code converter CC supplies a reset signal GR when the voice region identifying signal $S_1$ is received and supplies a set signal GS otherwise, thereby setting and resetting the flip-flop F. The output gate G is enabled with the flip-flop F in the reset state.

In the drawings, a digital-to-analog converter is labeled DAC, a low pass filter LPF. a speaker driver DD and a loud speaker SP.

Figure 3:
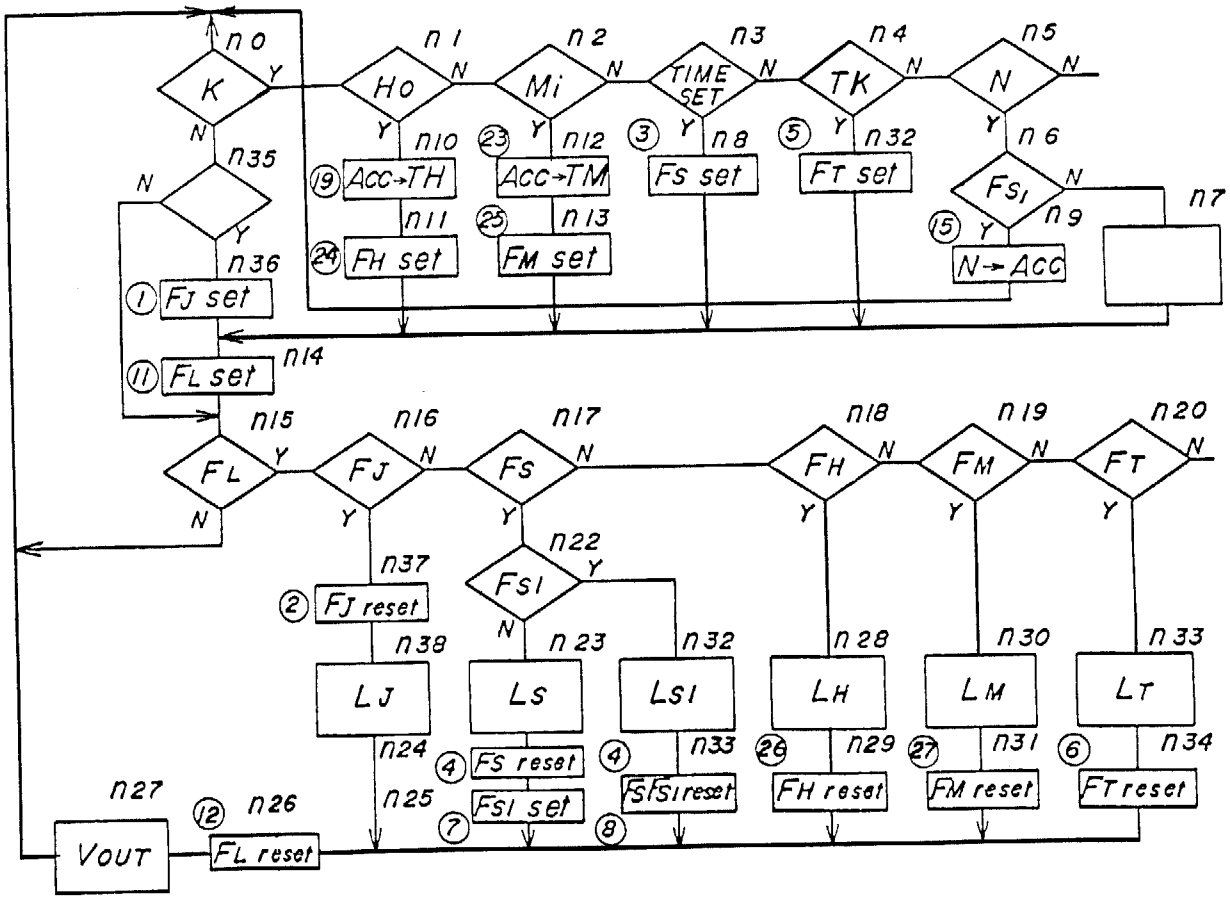
FIG. 3 is a flow chart for explanation of operation of the clock calculator of FIG. 1.

Operation of the above device will be described by reference to a flow chart of FIG. 3. The step $n_0$ is executed to decide if any key input has been entered and selects any of the steps $n_1$, $n_2$, $n_3$, $n_4$, $n_5$ . . . for identifying the type of an actuated key. For example, if a digit key N is identified during the step $n_5$, then the step $n_6$ decides if a flip-flop $F_{S1}$ is in the set state and if negative the next step $n_7$ is reached so that the key input is treated as an input to the calculator.

The step $n_3$ senses the presence of an actuated time set key [TIME.SET] and if so the step $n_8$ becomes operative to generate the micro-instruction ③ and set a flip-flop $F_S$. As will be described later, the flip-flop $F_{S1}$ is set. Upon the actuation of the digit key N subsequent to that of the time set key [TIME.SET] the step $n_6$ perceives the flip-flop $F_{S1}$ in the set state, followed by the step $n_9$ wherein the micro-instruction (15) is developed to load the instantaneous input into the accumulator ACC. The step $n_1$ decides if a hours unit selection key [$H_O$] is depressed and if affirmative the step $n_{10}$ follows wherein the microinstruction (19) is developed to transfer the contents of the accumulator ACC into the register TH. Thereafter, the step $n_{11}$ is executed to generate the micro-instruction (24) and set a flip-flop $F_H$. The step $n_2$, on the other hand, is to sense if a minutes unit selection key Mi is actuated, followed by the step $n_{12}$, when the affirmative answer is given, wherein the micro-instruction (23) is developed to unload the accumulator ACC into the minutes register TM and the next succeeding step $n_{13}$ wherein the micro-instruction (25) is developed to set a flip-flop $F_M$.

The time set mode is initiated upon the actuation of the time set key [TIME.SET] and any desired time is set after a succession of the actuations of the digit keys N, the hours unit selection key ($H_O$) and the minutes selection key ($M_O$).

When the time set key [TIME.SET] is actuated, the step $n_{14}$ is executed to generate the micro-instruction (11) and set a flip flop $F_L$ and the step $n_{15}$ senses the flip flop $F_L$ in the set state, followed by the steps $n_{16} \rightarrow n_{17} \rightarrow$ for monitoring the operating states of the respective flip flops. In this case, since the flip flop $F_S$ has been set upon the actuation of the time set key [TIME.SET], the step $n_{17}$ results in the affirmative answer as to the flip flop $F_S$, rendering the step $n_{22}$ operative to monitor the set state of the flip-flop $F_{S1}$. If the flip-flop $F_{S1}$ is not in the set state, then the step $n_{23}$ is executed to transfer a series of the word data $L_S$ from the program memory RU to the memory unit RM.

Figure 5:
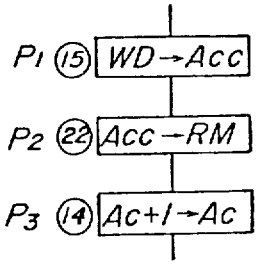
FIGS. 5 through 7 are flow charts detailing operation of the clock calculator.

As depicted in FIG. 4, the word data $L_S$ has a chain of the word data in which $m_1$ generates the micro-instruction (13) to reset the address counter AC and $m_2$–$m_{14}$ send a the word date of "tadaima kara ji fun wo settei shimasu (its English version is "please set time in hours and minutes soon") including pause codes Pa to the program memory RM. This transferring procedure is carried out as shown in a flow chart of FIG. 5. $P_1$ generates the micro-instruction (15) and transfers the word data (e.g., "tadaima" in $m_2$) from the program memory RU into the accumulator ACC. Subsequently, $P_2$ generates themicro-instruction (22) for transference into the memory unit RM. In order to lead the next succeeding word data (the pause code $P_{a2}$ in $m_3$ in the illustrated example) into the next address, the micro-instruction (14) is developed to increment one the address. If the word data $L_S$ are completely transferred into the memory unit, the step advances toward $n_{24}$ and $n_{25}$ wherein the microinstructions (4) and (7) are respectively developed to reset the flip-flop $F_S$ and set the flip-flop $F_{S1}$.

Figure 6:
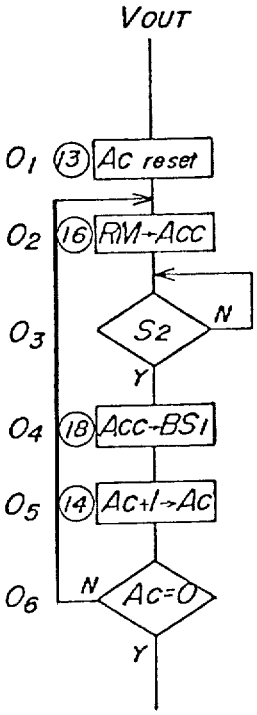

Then, the step $n_{26}$ is effected to generate the micro-instruction (12) and reset the flip-flop $F_u$, followed by the step $n_{27}$ which is a voice output routine as shown in FIG. 6. This includes $O_1$ for generating the micro-instruction (13) and resetting the address counter AC, $O_2$ for generating the micro-instruction (16) and transferring the word data from the memory unit RM into the accumulator ACC, $O_3$ for deciding if a signal $S_2$ has been developed and in other words whether the address counter VAC is reset or whether the END code detector JE senses the presence of the END code. When the signal $S_2$ is outputted, $O_4$ is reached where the micro-instruction (18) is developed to transfer the word data from the accumulator ACC into the output buffer $BS_1$. This step allows audible outputs corresponding to the word data to be delivered later. While the audible outputs are delivered, the above mentioned signal $S_2$ is not developed and the next succeeding word data remain stored in the accumulator ACC. $O_5$ develops the micro-instruction (14), increments the address counter AC and specifies the read-out position for the next succeeding word data. $O_6$ decides if the address counter AC reaches "O". $O_2$–$O_5$ are repeatedly executed until the overall regions of the illustrated example, the contents of the memory unit RM includes the steps up to $m_{14}$ to complete the delivery of the advance announcement "please set time in hours and minutes soon".

Upon the delivery of the advance announcement the step $n_0$ is returned and ready for the subsequent actuation of any key. If the hours unit selection key $H_O$ is actuated subsequent to the actuation of the digit key N, then the step $n_{18}$ is effected to decide if the flip-flop $F_H$ is in the set state, through the steps $n_{14}$ and $n_{15}$. The step $n_{28}$ is carried out to transfer word data $L_H$ into the memory unit RU. The word data $L_H$, as indicated in FIG. 4, include""X" ji wo settei shimashita, tadaimakara fun wo settei shimasu" (its English version if "time X in hours has been set and please set time in minutes soon"). The transmission of the hours information TH, i.e. the process $m_2$ for $L_H$ is carried out in the following manner as depicted in a flow chart of FIG. 7.

$q_1$ is effected to generate the micro-instruction (17) and transfer the contents of the hours counter TH or the minutes counter TM into the accumulator ACC. When the hours unit selection key $H_O$ is actuated, the output selection circuit ST selects the hours counter TH side in response to the micro-instruction (21) and "hours" information as decided by the digit keys N and the hours unit selection key [$H_O$] is sent to the accumulator ACC. $q_2$ generates the micro-instruction (22) and unloads the accumulator ACC into the memory unit RU. The next step $q_3$ develops the micro-instruction (14) and increments the address counter AC.

When the word data including the "hours" information TH are transferred into the memory unit RM in this manner, the step $n_{29}$ is reached where the flip-flop $F_H$ is reset, followed by the steps $n_{26} \rightarrow n_{27}$. The step $n_{27}$ for the delivery of an audible message "time X in hours has been set and time in minutes is about to be set."

Figure 7:
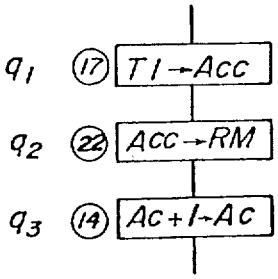

Since the step $n_{19}$ is effected to decide the set state of the flip-flop $F_M$ upon the actuation of the minutes unit selection key [Mi], the step $n_{30}$ is carried out to transfer word data $L_M$ into the memory unit RM. By way of example, FIG. 4 shows the word data $L_M$ "time TM in minutes has been set." The "minutes" information TM is carried out in $m_2$ as indicated in FIG. 7. When this occurs, the output selection circuit ST responds to the micro-instruction (20) for selection of the minutes register TM side. After the word data $L_M$ have been loaded into the memory unit RM in this manner, the step $n_{31}$ is at work to develop the micro-instruction (27) and reset the flip-flop $F_M$, followed by $n_{26} \rightarrow n_{27}$. During the step $n_{27}$ an audible message "time TM in minutes has been set" is delivered to the operator.

When the time set key [TIME.SET] is actuated under these circumstances, the steps $n_{17} \rightarrow n_{22}$ are executed and the step $n_{32}$ is reached because of the flip flop $F_{S1}$ in the set state. The step $n_{32}$ transfers the word data $L_{S1}$ into the memory unit RM. In other words, as indicated in FIG. 14, the word data $L_{S1}$ "time in hours (TH) and minutes (TM) has been set" are transferred and delivered during the step $n_{27}$. The $n_{33}$ stands behind the step $n_{32}$ and develops the micro-instructions (4) and (8) and resets the flip flops $F_S$ and $F_{S1}$, thus completing the time set mode.

Provided that the actuation of a time recall key TK (the tough switch type in FIG. 1) is sensed by the step $n_4$, the step $n_{32}$ is effected to generate the micro-instruction useful in setting a flip flop $F_T$. That set state is sensed by the step $n_{20}$ and the step $n_{33}$ transfers word data $L_T$ into the memory unit RM, which word data are audibly delivered through the step $n_{27}$. For example, a message "it is now TH in hours and TM in minutes" indicative of the instantaneous time when the time recall key [TK] is actuated. The step $n_{34}$ generates the micro-instruction (6) and resets the flip flop $F_T$.

If any key is not actuated, the steps $n_0 \rightarrow n_{35} \rightarrow n_{15} \rightarrow n_{10} \rightarrow \ldots$ are repeated and the specific time detector JT senses "59 minutes 50 seconds" each hour and makes the steps $n_{36} \rightarrow n_{14}$ operative. During the step $n_{36}$ the micro-instruction (1) is developed and the flip-flop $F_J$ is set. During $n_{14}$ the flip-flop $F_L$ is set. Accordingly, a chain of the steps $n_{15} \rightarrow n_{16} \rightarrow n_{37} \rightarrow n_{38}$ are practiced. The step $n_{37}$ develops the micro-instruction (2) and resets the flip-flop $F_J$, whereas the step $n_{38}$ transfers word data $L_J$ into the memory unit RM. As indicated in FIG. 4, the word data $L_J$ carry a message "tadaima kara TH ji rei fun wo oshirase shimasu, pu, pu, pu, puhn" (its English version is "this is to announce that it is now TH hours 00 minutes, peep, peep, peep, peep"). The "hours" information TH in $m_6$ is transferred while the "hours" information from the hours register TH is incremented by one. The correct time comes when the last monotone is released. The step $n_{27}$ delivers this message.

The pause codes $P_{a1}$, $P_{a2}$ and so forth shown in FIG. 4 are silent data and useful in appropriately dividing the messages and controlling the full length of the messages.

Whereas the present invention has been described with respect to specific embodiments thereof, it will be understood that various changes and modifications will be suggested to one skilled in the art, and it is intended to encompass such changes and modifications as fall within the scope of the appended claims.

I claim:

1. A timepiece including a voice synthesizer system for automatically instructing an operator by audibly presenting time setting instructions comprising:

time indicating means for informing the operator of the actual time of day;

first storage means for holding synthetic speech data in a plurality of locations;

second storage means for holding position data representative of the locations of said synthetic speech data, said position data being stored in a plurality of locations, each representative of a portion of a said instruction;

first selection means for selecting locations in said second storage means, thereby selecting instructions to be audibly reproduced;

said instructions audibly instructing the operator of the correct procedures for programming the actual time of day;

second selection means for recalling synthetic speech data from said first storage means in correspondence to the position data produced by said second storage means; and synthetic speech generator means for producing audible instructions derived from said synthetic speech data to instruct a timepiece user of the correct time setting procedures.

2. The timepiece of claim 1, wherein said synthetic speech generator comprises:

a digital analog converter for converting said synthetic speech data into an audio signal;

a low pass filter for filtering high frequency noise out of said audio signal; and a speaker system for converting said audio signal into audio waves.

3. A voice-synthesizer according to claim 1 wherein said first and second storage means comprise read only memories.

* * * * *